US007066238B2

(12) United States Patent
Hohenbichler et al.

(10) Patent No.: US 7,066,238 B2
(45) Date of Patent: Jun. 27, 2006

(54) METHOD FOR PRODUCING A METAL STRIP USING A TWO-ROLLER CASTING DEVICE

(75) Inventors: Gerald Hohenbichler, Kronstorf (AT); Gerald Eckerstorfer, Linz (AT); Armin Schertler, Guntramsdorf (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 0 days.

(21) Appl. No.: 10/519,512

(22) PCT Filed: Jun. 18, 2003

(86) PCT No.: PCT/EP03/06468

§ 371 (c)(1),
(2), (4) Date: Feb. 1, 2005

(87) PCT Pub. No.: WO04/000487

PCT Pub. Date: Dec. 31, 2003

(65) Prior Publication Data

US 2006/0054298 A1 Mar. 16, 2006

(30) Foreign Application Priority Data

Jun. 25, 2002 (AT) ..... A 946/2002

(51) Int. Cl.
*B22D 11/06* (2006.01)

(52) U.S. Cl. ..... 164/480; 164/428
(58) Field of Classification Search ..... 164/428, 164/480
See application file for complete search history.

(56) References Cited

U.S. PATENT DOCUMENTS

| | | | | |
|---|---|---|---|---|
| 5,154,222 | A | 10/1992 | Salaris et al. | |
| 5,437,325 | A | 8/1995 | Legrand et al. | |
| 5,588,479 | A | 12/1996 | Leadbeatter et al. | |
| 5,628,359 | A | 5/1997 | Legrand et al. | |
| 6,296,046 | B1 * | 10/2001 | Jeong et al. | 164/452 |
| 6,497,270 | B1 | 12/2002 | Breviere et al. | |

FOREIGN PATENT DOCUMENTS

| | | |
|---|---|---|
| DE | 100 56 916 A1 | 5/2002 |
| EP | 0 285 963 | 10/1988 |
| EP | 0 380 698 | 8/1990 |
| EP | 0 390 924 | 10/1990 |
| EP | 0 546 206 | 6/1993 |
| JP | 63-26243 | 2/1988 |
| JP | 2-46951 | 2/1990 |

(Continued)

*Primary Examiner*—Kuang Y. Lin
(74) *Attorney, Agent, or Firm*—Ostrolenk, Faber, Gerb & Soffen, LLP

(57) ABSTRACT

A process and apparatus for producing a metal strip using a two-roller casting device formed by two oppositely rotating casting rollers with parallel casting-roller axes and two side plates which bear against end sides of the casting rollers. The metal melt is conveyed out of the casting gap formed by the casting rollers as an at least partially solidified metal strip. To improve the sealing of the melt pool at the start of casting and in the event of parasitic solidifications passing through the casing gap, the side plates during a first time interval are moved onto the end sides of the casting rollers in a first direction of movement parallel to the casting-roller axes, and the side plates during a second time interval, are moved onto a portion of the lateral surfaces of the casting rollers in a second direction of movement parallel to the casting direction in the casting gap.

32 Claims, 5 Drawing Sheets

FOREIGN PATENT DOCUMENTS

| | | |
|---|---|---|
| JP | 2-70359 | 3/1990 |
| JP | 5-269550 | 10/1993 |
| JP | 2000-42692 | 2/2000 |
| WO | WO 98/04369 | 2/1998 |

* cited by examiner

METHOD FOR PRODUCING A METAL STRIP USING A TWO-ROLLER CASTING DEVICE

CROSS-REFERENCE TO RELATED APPLICATIONS

This is a U.S. national stage application of PCT/EP03/06468 filed 18 Jun. 2003, which PCT application claims priority of Austrian application number A 946/2002 filed 25 Jun. 2002. The PCT International application was published in the German language.

BACKGROUND OF THE INVENTION

The invention relates to a process for producing a metal strip using a two-roller casting device, and to a two-roller casting device for carrying out the process. It is preferable for a two-roller casting device of this type to be used for the production of a steel strip of low thickness, in particular in a thickness range from 1.0 mm to 10 mm.

The central component of a two-roller casting installation is formed by two oppositely rotating casting rollers with casting-roller axes arranged parallel to one another, and two side plates which bear against the opposite end sides of the casting rollers. The distance between the two casting-roller axes is set such that the lateral surfaces of the casting rollers form a substantially parallel casting gap which corresponds to the casting thickness of the metal strip that is to be cast. The lateral surfaces of the interacting casting rollers and two end sides of the side plates form a space, which is closed in the peripheral direction, for receiving the metal melt, which is supplied via an inlet, solidifies at the cooled lateral surfaces of the casting rollers and is conveyed out of the casting gap in the form of an at least substantially fully solidified metal strip. An installation of this design and function is already known, for example, from WO 98/04369.

The end sides of the casting rollers lie in parallel planes with low tolerances. The side plates bearing against the end sides of the casting rollers consist of refractory material and are embedded in a carrying frame which is part of a side plate manipulator or of a supporting and carrying apparatus for the side plates. Numerous embodiments of devices of this type are known, for example from EP-A 714 715 or EP-B 620 061.

The side plates, which are made from refractory material, are pressed onto the end sides of the casting rollers with a predetermined pressure in order to ensure that they bear tightly against these end sides. The side plates are exposed to high and locally differing mechanical and thermal loads. In the melt pool and in the region of the casting gap there is direct contact with the metal melt and therefore considerable thermal and/or chemical wear; in the region of the contact surface between side plates and end sides of the casting rollers, the wear is predominantly mechanical on account of the movement of the components relative to one another under pressure and at elevated temperature. To minimize the overall wear and to increase the service life of the side plates, there are known solutions in which the side plates are made from different materials according to the particular local requirements (WO 98/04369).

To compensate for the wear and to maintain sealed bearing, the side plates, according to the prior art, are pressed onto the casting roller surface or moved continuously toward the casting roller lateral surface.

In the embodiment of a two-roller casting device of the generic type, as is known, for example, from EP-A 714 715 or EP-B 620 061, side plates which have been moved onto the end sides of the casting rollers are continuously held under contact pressure. The side plates are continuously worn away during the production cycle as a function of the set contact pressure and the casting rate, and this limits the duration of casting which can be achieved. A further unpleasant process engineering side-effect of this arrangement is the production of wear marks on the contact surface between side plates and solidified strip shell.

By contrast, EP-B 285 963 or EP-B 380 698 has disclosed, for a different arrangement of casting rollers and side plates, placing the refractory side plates, over a partial region of their thickness, on a narrow edge strip of the casting rollers and moving the side plate toward the casting gap at a predetermined feed rate during the casting operation. According to the design solutions described, the side plates are fixed on a carrier plate or guided in a frame and are moved onto the casting rollers by a spindle drive, a rack or similar mechanical means. The casting rollers are covered with wearing plates at their end sides, which ensure corresponding abrasion without the expensive casting rollers themselves being subject to wear from the side plates. On the one hand, the encircling contact grooves between wearing plates and side plates have an adverse affect on the formation of the edges of the strip, on account of the different temperatures of the two components, and on the other hand end-side sealing of the melt space is insufficiently ensured on account of the exclusively mechanical vertical guidance of the side plates.

SUMMARY OF THE INVENTION

Therefore, it is an object of the present invention to avoid these drawbacks of the prior art and to propose a process for producing a metal strip in a two-roller casting device, as well as the two-roller casting device required for this purpose, in which complete sealing of the melt space is ensured both at the start of casting and in the event of parasitic solidifications passing through the casting gap. Furthermore, the horizontal wear to the side plates at the contact surface with the casting roller end sides is to be reduced to the same extent as the wear in the contact surface between the side plates and the solidified strip shells, and at the same time improved strip edge quality on emerging from the casting gap is to be achieved.

In a process of the generic type, this object is achieved by virtue of the fact that the side plates, in a first time interval, are moved onto the end sides of the casting rollers in a first direction of movement parallel to the casting-roller axes, and that the side plates, in a second time interval, are moved onto a portion of the lateral surfaces of the casting rollers in a second direction of movement parallel to the casting direction in the casting gap.

The combination of a horizontal movement of the side plates in the direction of the casting-roller axes and a vertical movement of the side plates in the casting direction, on account of the abrasion, produces a step in the side plate which allows both an end-side and a circumferential-side sealing surface to be produced and therefore allows sealing to be achieved. By a corresponding combination of the two movements, both sealing surfaces are renewed continuously or at intervals.

This is expediently achieved by virtue of the fact that, in chronological order, the first time interval overlaps the second time interval at least in a subsection.

However, this can also be achieved by the fact that, in chronological order, the second time interval overlaps the first time interval at least in a subsection.

According to a preferred embodiment, the first time interval starts before the second time interval. In this way, the sealing of the melt space is achieved by virtue of the fact that in the first time interval a feed movement of the side plates takes place in the direction of the casting-roller axes, resulting in grinding-in of the side plates at the end sides of the casting rollers, and grinding-in of the side plates at the lateral surface of the casting rollers only takes place in a time-offset manner as a result of a vertical movement in the casting direction, to an extent corresponding to the wear caused by the movement of the side plates in the direction of the casting-roller axes.

The first time interval starts when the metal melt is fed into the melt space or before this. A certain time advance makes it possible to overcome manufacturing-related or assembly-related skew positioning of the side plates and manufacturing-related or thermally induced deformation of the side plates and the resulting gaps between casting rollers and side plates caused by the grinding-in operation.

The materials used for the side plates have to have a high ability to withstand thermal loads, a high resistance to thermal shocks, a high resistance to abrasion on contact with the metal melt and the casting-roller surface, and resistance to chemical erosion and corrosion. Materials of this type consist of a mixture of substances comprising a plurality of components from refractory base materials, such as $SiO_2$, $Al_2O_3$, BN, $Si_3N_4$, $ZrO_2$, graphite, etc. The side plates are moved onto the casting rollers as a function of the wearing properties of the refractory material used. The side parts are in single-part form. If they contain different materials in different portions, in order to optimally adapt to the contact with the casting roller and the metal melt, these side plate parts are joined together in a common carrying frame to form a jointly movable component.

According to an expedient embodiment, the first time interval is formed by three sections, specifically

- a starting phase, in which the side plates, during a time period of at most 90 sec, are moved onto the end sides of the casting rollers at a feed rate which corresponds to material wear to the side plates of less than 50 mm/h, preferably from 1 mm/h to 30 mm/h,
- a transition phase, in which the side plates, during a period of at most 3 min, are moved onto the end sides of the casting rollers at a feed rate which corresponds to material wear to the side plates of less than 20 mm/h,
- a steady-state operating phase, in which the side plates are moved onto the end sides of the casting rollers at a feed rate which corresponds to material wear to the side plates of between 0.2 mm/h and 4 mm/h.

Therefore, in this process, predetermined wear rates at the side plates are achieved within defined time intervals by open-loop or closed-loop control of the feed rate in the direction of the casting-roller axes, in this way allowing the two-roller casting installation to be started up without problems.

According to a further expedient embodiment, the first time interval is formed by three sections, specifically

- a starting phase, in which the side plates, during a period of at most 90 sec, are pressed onto the end sides of the casting rollers with a contact pressure which corresponds to material wear to the side plates of less than 50 mm/h, preferably from 1 mm/h to 30 mm/h,
- a transition phase, in which the side plates, during a period of at most 3 min, are pressed onto the end sides of the casting rollers with a contact pressure which corresponds to material wear to the side plates of less than 20 mm/h,
- a steady-state operating phase, in which the side plates are pressed onto the end sides of the casting rollers with a contact pressure which corresponds to material wear to the side plates of between 0.2 mm/h and 4 mm/h.

In both alternative processes, predetermined wear rates at the side plates are achieved within defined time intervals by open-loop or closed-loop control of the contact pressure in the direction of the casting-roller axes, in this way allowing the two-roller casting installation to be started up without problems.

In both variants, the second time interval starts at the latest 30 min, preferably as early as 10 min, after the start of the first time interval. To make good use of the advantage of the sealing of the space for receiving melt on two sides, i.e. both at the end side and on the circumferential side, the second time interval starts substantially at the start of the steady-state operating phase.

Analogously to the two procedures described above for the first time interval, it is similarly provided for the second time interval that the side plates, during this second time interval, are moved onto a portion of the lateral surface of the casting rollers at a feed rate which corresponds to material wear to the side plates of 2 mm/h to 20 mm/h, preferably 4.0 to 10 mm/h, or that the side plates, during the second time interval, are pressed onto a portion of the lateral surface of the casting rollers with a contact pressure which corresponds to material wear to the side plates of 2 mm/h to 20 mm/h, preferably 4.0 to 10 mm/h.

The sealing surfaces which have been ground into the side plates are gradually damaged and broken down by erosion and corrosion during the ongoing casting operation, and consequently to produce a perfect metal strip it is sufficient for the side plates, during the second time interval, to be moved intermittently, with movement phases and stationary phases alternating and the stationary phases of the side plates not exceeding 30 min, preferably 5 min. In this case, it is sufficient for the side plates, during each movement phase, to be moved 0.01 to 2.0 mm, preferably 0.1 to 1.0 mm, onto a portion of the lateral surface of the casting rollers.

After a new refractory side plate has been fitted into the side-plate carrying apparatus or the side plate manipulator, it is advantageous if the first time interval is directly preceded by a grind-in phase, in which the side plates, during a period of at most 120 sec, are pressed onto the end sides of the casting rollers at a feed rate or with a contact pressure which corresponds to mean material wear to the side-plates of at least 10 mm/h, preferably at least 20 mm/h. The formation of the sealing surfaces on the side plates is positively influenced if the side plates, during a subsection of this grinding-in phase, are if appropriately additionally pressed onto a portion of the lateral surfaces of the casting rollers with a high contact pressure.

An expedient preparation phase for preparing the side plates for the casting operation also consists in the fact that the first time interval is preceded by a grinding-in phase in which mean horizontal material wear to the side plates of at least 0.3 mm is produced, this grinding-in phase being carried out with cold or preheated side plates, and if appropriate intermediate heating being carried out between this grinding-in phase and the start of the first time interval. For this purpose, heating devices, which may be formed by gas burners or electrical heating devices, such as induction heaters, etc., are provided on the rear side of the side plates.

The object set in the introduction is achieved, in a two-roller casting device having two casting rollers arranged parallel and two side plates which bear against the end sides of the casting rollers and are supported in side-plate carrying apparatuses, by virtue of the fact

- that each side-plate carrying device has horizontal guides for implementing a feed movement of the side plate in the direction of the casting-roller axes,
- that each side-plate carrying device is assigned a horizontal-adjustment device for horizontal displacement of the side plate and a position-recording device for recording the horizontal position of the side plate,
- that each side-plate carrying device has vertical guides for implementing a feed movement of the side plate in the casting direction, based on the casting gap,
- that each side-plate carrying device is assigned a vertical-adjustment device for the vertical displacement of the side plate and a position-recording device for recording the vertical position of the side plate,
- that a computer unit is connected, via signal lines, to the horizontal-adjustment devices, the vertical-adjustment devices and the position-recording devices in order to transmit measurement and control signals.

In this context, the terms "horizontal" and "vertical" are to be interpreted as directional indications which in no way relate exclusively to the force of gravity. The term "horizontal" is based on the parallel casting-roller axes and the longitudinal extent thereof. The term "vertical" is based on the casting direction at the narrowest point of the casting gap formed by the casting rollers (kissing point). Therefore, directions which differ from the direction of action of the force of gravity are possible, depending on the position of the casting rollers with respect to one another. If corresponding process models are used as a basis, this design of installation allows a process-controlled sequence of the side plate setting in accordance with a predetermined sequence plan taking account of input conditions, such as steel grades, melt temperature and superheating temperature, casting thickness, casting rate, side plate materials, etc., and also taking into account current disruptions to the production process, such as irregular side plate wear, changes to the casting rate and the like.

One expedient configuration of the two-roller casting device consists in the fact that the horizontal-adjustment devices and the vertical-adjustment devices are assigned individual contact pressure measuring devices for determining the contact pressure of the side plates on the casting rollers in the horizontal and vertical directions, and the horizontal-adjustment devices and the vertical-adjustment devices are connected to the computer unit via signal lines. The pressure measurement makes it possible to draw conclusions as to the current side plate wear and gives measurement data as a basis for a continuous improvement to the start-up method according to the invention, in particular when self-teaching systems and neural networks are incorporated in the control and management system of the plant.

The computer unit is expediently designed as an individual control circuit with a higher-level plant control system. This specifically allows variable influencing variables from other installation components to be taken into account for this individual control circuit.

A structurally simple configuration and systematic structuring of the side-plate carrying device consists in the fact that the side-plate carrying device is formed by a basic frame fixed to the installation, an adjustment frame and a carrying frame, the adjustment frame being supported on the basic frame via horizontal guides, and the carrying frame for the side plate being supported on the adjustment frame via vertical guides, and the horizontal-adjustment device being arranged between the basic frame and adjustment frame and the vertical-adjustment device being arranged between the adjustment frame and carrying frame for the side plate.

To preheat the side plates, each side plate is assigned a heating device, which is formed by gas burners or electrical heating devices and is arranged on the rear side of the side plates.

BRIEF DESCRIPTION OF THE DRAWINGS

Further advantages and features of the present invention will emerge from the following description of non-limiting exemplary embodiments, in which reference is made to the appended figures, in which.

DESCRIPTION OF A PREFERRED EMBODIMENT

Figure 1:
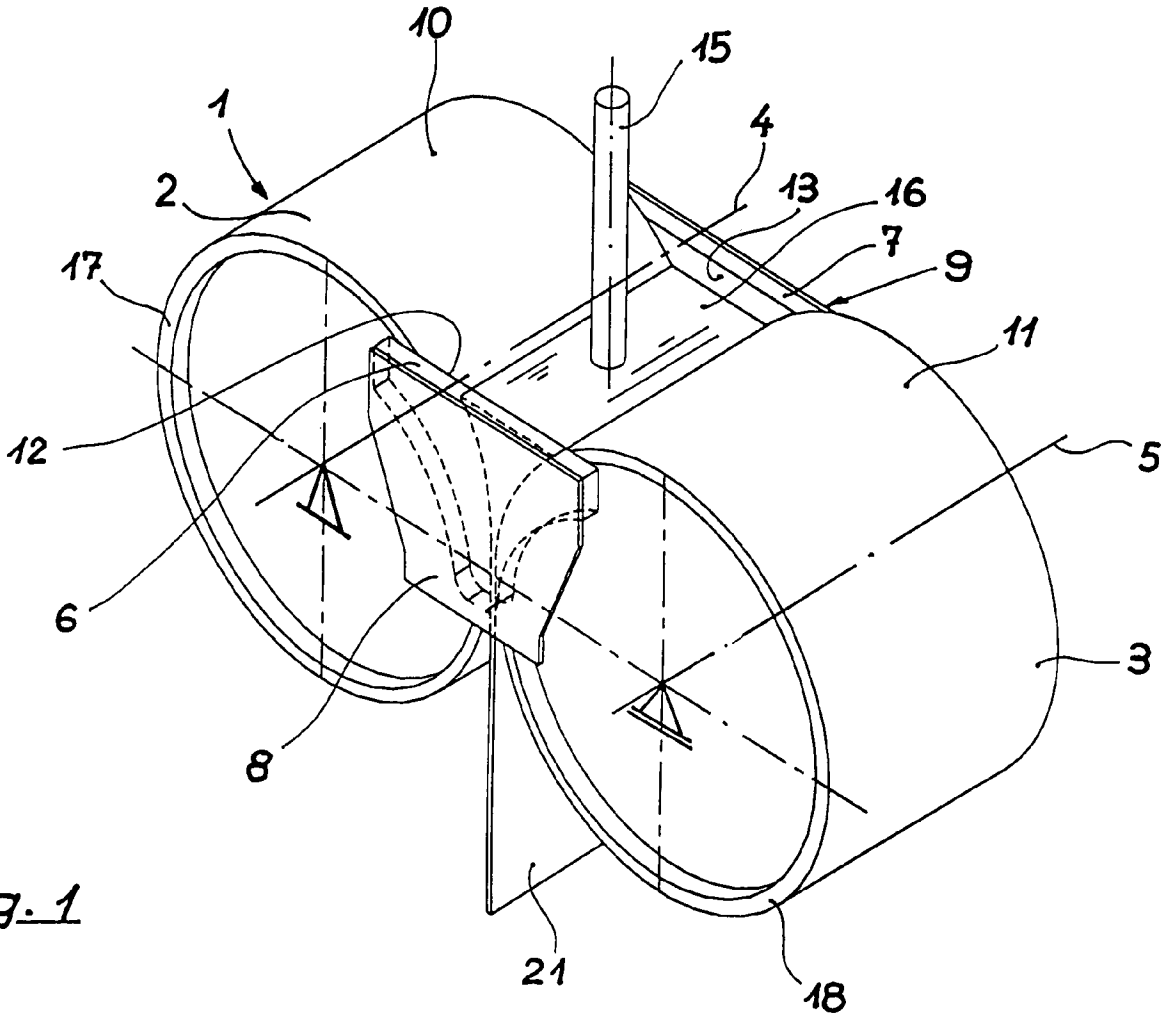
FIG. 1 shows a two-roller casting installation for applying the process according to the invention.

A core device, suitable for carrying out the process according to the invention, of a two-roller casting installation 1 as diagrammatically depicted in FIG. 1 comprises two internally cooled, driven casting rollers 2, 3 which rotate in opposite directions about parallel casting-roller axes 4, 5, and two side plates 6, 7, which are made from refractory material and are in each case embedded in or secured to a carrying frame 8, 9. The lateral surfaces 10, 11 of the casting rollers 2, 3 and the end sides 12, 13 of the side plates 6, 7 together form a melt pool 14 which is closed off in the circumferential direction and receives the superheated metal melt 16 supplied through a submerged casting nozzle 15. To avoid leaks or penetration of metal melt into gaps between side plates and casting rollers, the side plates 6, 7 are placed onto the end sides 17, 18 of the casting rollers 2, 3.

Figure 2:
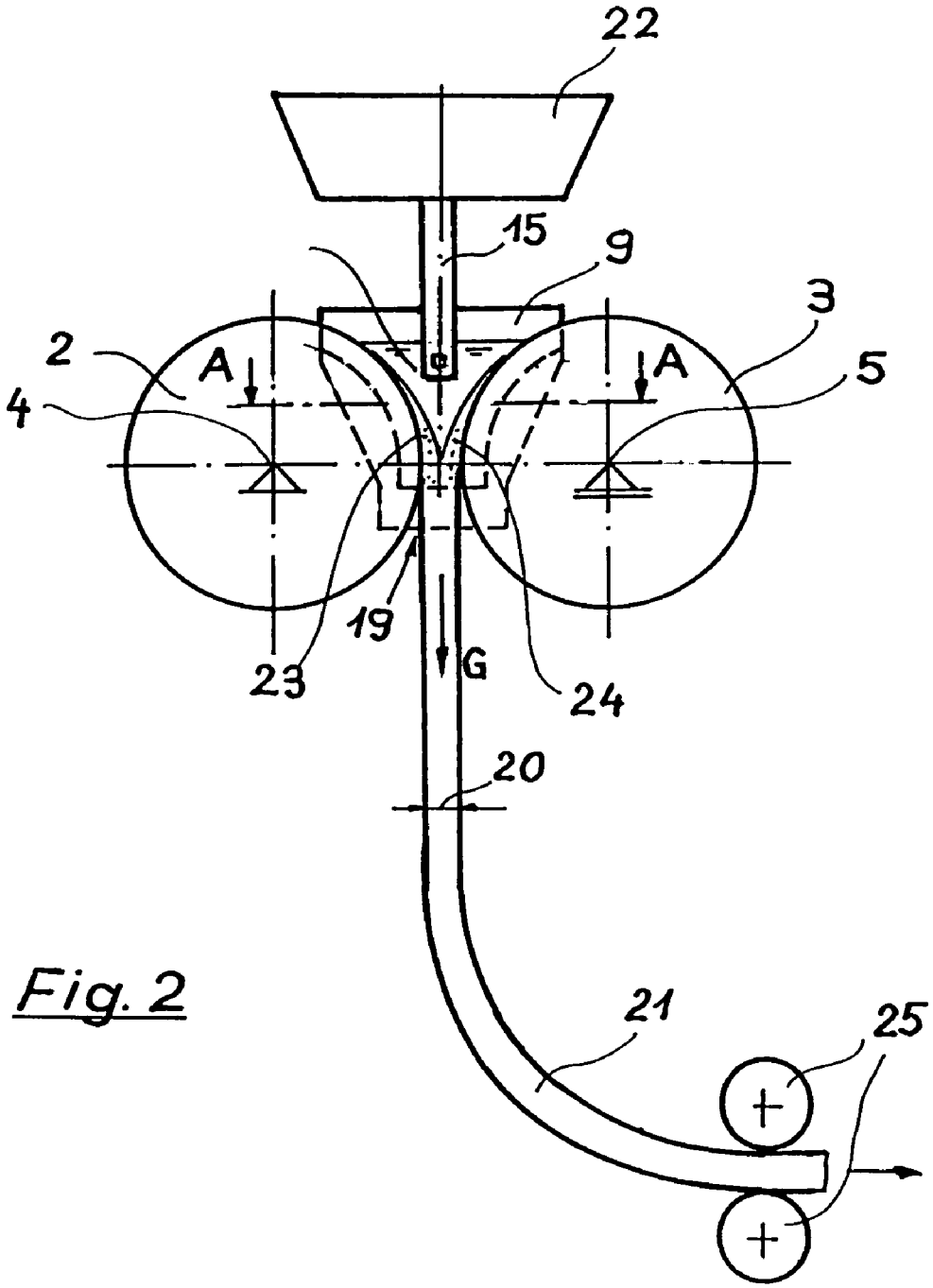
FIG. 2 shows a vertical section through the two-roller casting installation shown in FIG. 1.

The casting roller 2 is supported rotatably in a fixed position in a carrying framework or carrying bearing (not shown). The casting roller 3 is supported in the carrying framework (not shown) in such a manner that it can be displaced parallel to the first casting roller 2, as indicated by the double arrow. As a result, it is possible to set a selectable casting gap 19, which corresponds to the thickness 20 of the cast metal strip 21, at the narrowest point between the two casting rollers 2, 3 (FIG. 2). The metal melt which is introduced from a tundish 22 via the submerged casting nozzle 15 into the melt pool 14 forms strand shells 23, 24 which gradually grow on the internally cooled lateral surfaces 10, 11 of the casting rollers 2, 3, are brought together in the casting gap 19 to form a substantially fully solidified metal strip 21 and are conveyed out of the casting gap through the rotation of the casting rollers. The cast strip is transported onward by a pair of driving rollers 25.

Figure 3:
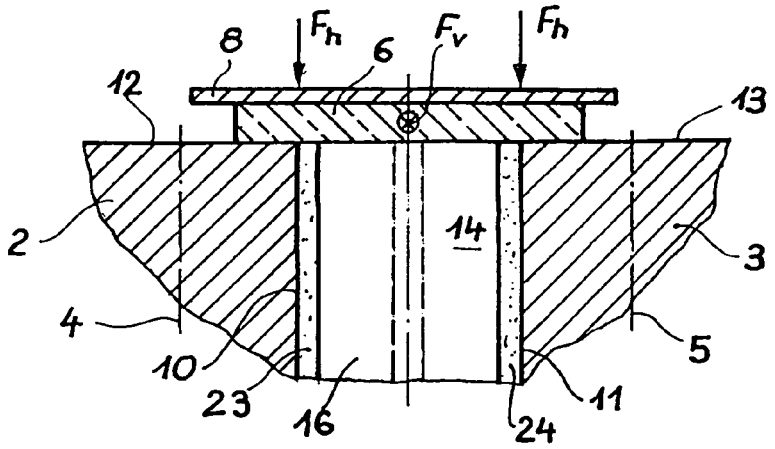
FIG. 3 shows the position and state of the side plate shortly after the start of the first time interval in a horizontal partial section through the two-roller casting installations on line A—A in FIG. 2.

FIG. 3 illustrates the positioning of a side plate 6 against the end sides 12, 13 of the casting rollers 2, 3 in an initial phase of the casting process with a new side plate made from refractory material. The melt pool 14 has been filled with metal melt 16, and strand shells 23, 24 are formed at the lateral surfaces 10, 11 of the casting rollers 2, 3. The side plate 6 is placed in a sealing manner onto the end side 12 of the casting roller 2 by horizontal forces $F_h$ acting on the carrying frame 8 of the side plate 6 parallel to the casting-roller axes 4, 5 and is moved in the direction of action of the horizontal forces $F_h$ during a defined time interval $\Delta t_1$. In the same way, within a defined time interval $\Delta t_2$, a vertical force $F_v$ is active in the casting direction and moves the side plate 6 toward the casting gap 19 within this time interval.

Figure 4:
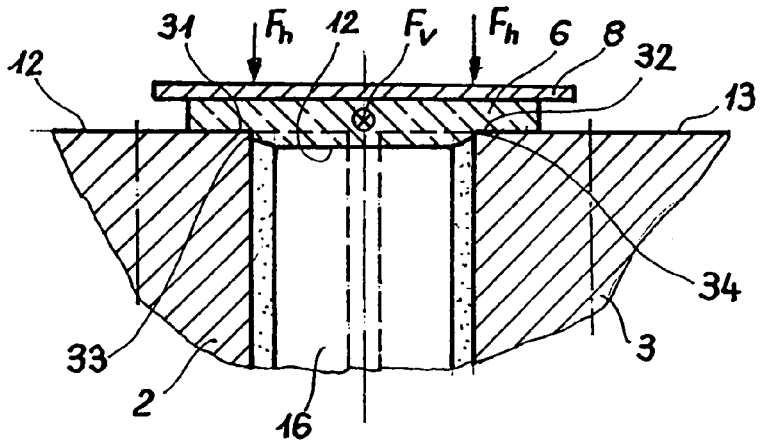
FIG. 4 shows the position and state of the side plate during the casting process in an advanced phase of the first or second time interval in a horizontal partial section through the two-roller casting installations on line A—A in FIG. 2, FIG. 5 diagrammatically depicts a side-plate carrying apparatus.

After a defined casting time, a state which is primarily determined by the wear to the refractory material at the end sides 12, 13 and at the lateral surfaces 10, 11 of the casting rollers 2, 3 which is predetermined by the setting movements is established at the side plate 6. This state is illustrated in FIG. 4. The combined side plate movement made up of horizontal forces $F_h$ and vertical force $F_v$ produces a step 30 at the side plates as a result of the controlled abrasion of refractory material, forming end-side sealing surfaces 31, 32 and circumferential-side sealing surfaces 33, 34. The sealing surfaces 31, 32, 33, 34 and that part of the side plate end side 12 which projects into the melt pool 14 make a significant contribution to improving the edges of the cast metal strip and to extending the service life of the side plates. The end face 12 of the side plate 6 which is exposed to the metal melt 16 becomes worn through system-induced chemical and mechanical erosion and corrosion.

Figure 5:
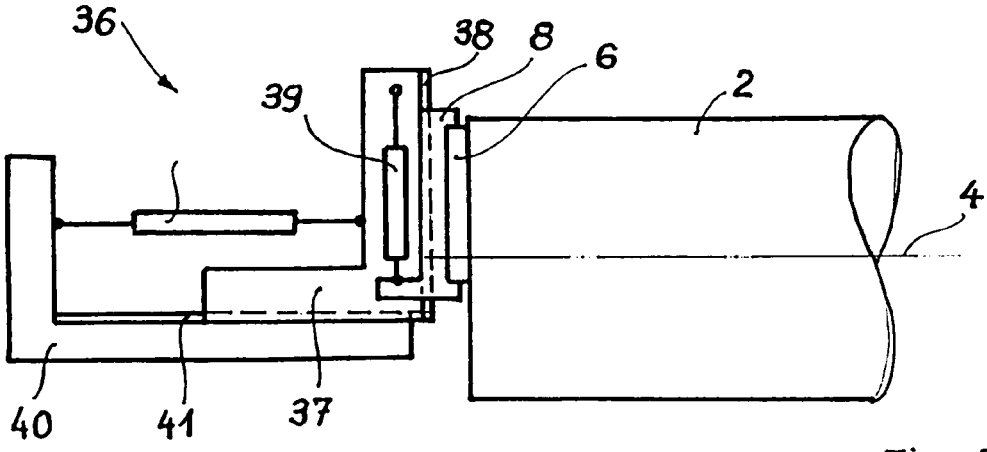

To implement the setting movements of the side plates, the latter are integrated in side-plate carrying apparatuses 36, one of which is diagrammatically depicted in FIG. 5. The side plate 6 is clamped resiliently in a carrying frame 8, so as to permit thermal expansions. To enable the side plates to be preheated to operating temperature, heating devices, which are not shown and are formed either by gas burners or by electrical heating devices, such as for example induction heating devices, are provided in a free space on the rear side of the side plates. This reduces sudden, locally high thermal loading of the side plates. The carrying frame 8 is guided vertically in the casting direction along vertical guides 38 on an L-shaped adjustment frame 37 and can be moved by a vertical-adjustment device 39 which is articulatedly mounted on the carrying frame 8 and on the adjustment frame 37. For its part, the adjustment frame 37 is supported on a stationary basic frame 40 and is arranged such that it can be displaced horizontally with respect to the latter, in the direction of the casting-roller axis 4, through horizontal guides 41. The horizontal-adjustment device 42 is articulatedly mounted on the basic frame 40 on one side and on the adjustment frame 37 on the other side. The vertical-adjustment device 39 and the horizontal-adjustment device 42 allow open-loop or closed-loop advancement and retreating setting movements of the side plates, which can be realized by various setting devices, such as for example by springs, pneumatic systems, hydraulic systems, electrical, mechanical or electro-mechanical drive systems or also combinations of these systems. These drive systems are preferably coupled to displacement-monitoring devices and allow accurate setting of positions and feed movements, based on preset values, such as contact pressure, feed rate, etc., which are predetermined as a time function by an open-loop control, closed-loop control or management system.

Figure 6:
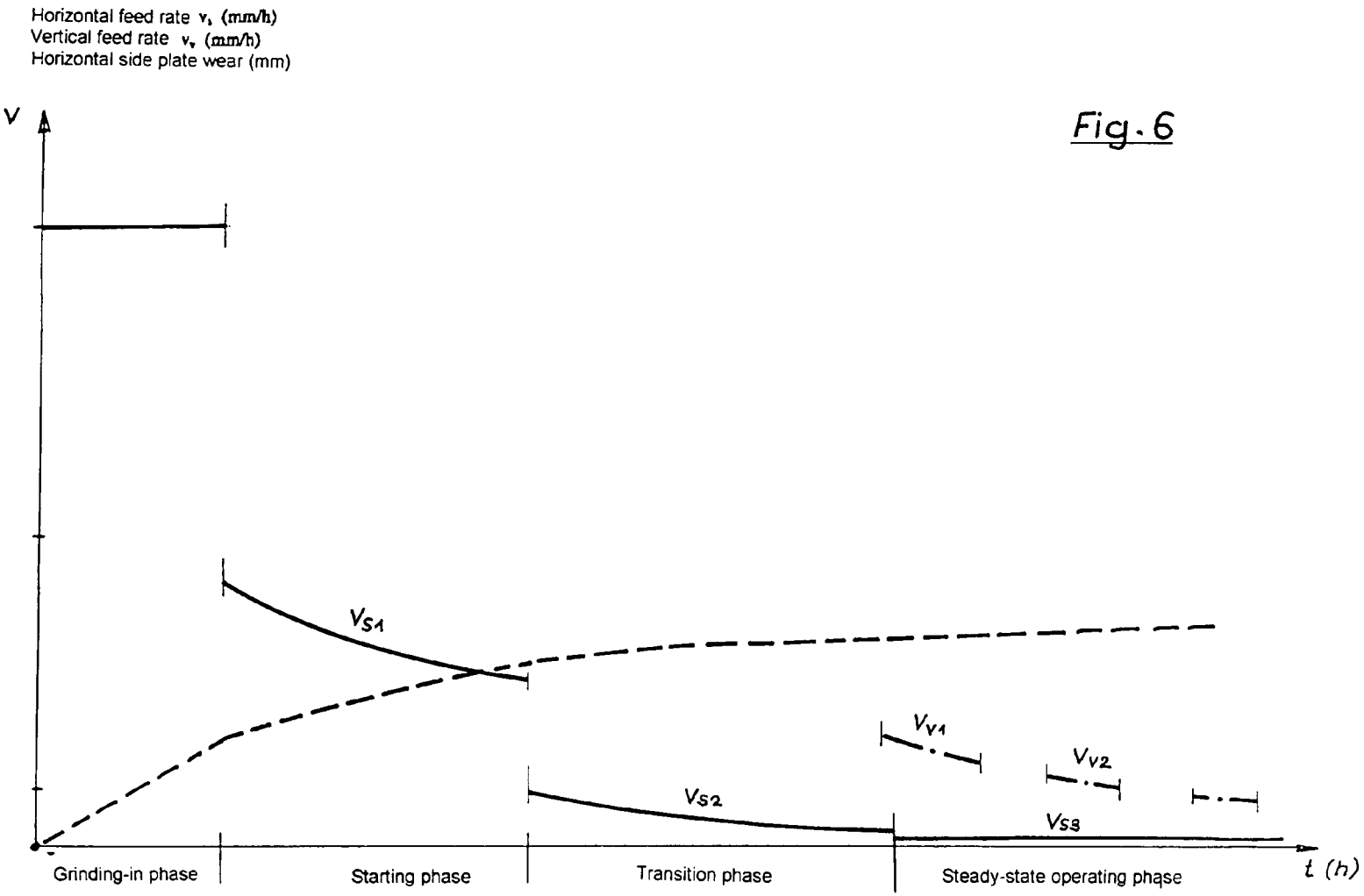
FIG. 6 shows an exemplary embodiment of the time sequence of the setting movements of the side plates and the side plate wear.

The individual process steps are clearly illustrated on the basis of FIG. 6 and are explained in more detail below. The wear to the side plates, on the one hand as an absolute value and on the other hand in mm/h, and therefore equally as an instantaneous feed rate of the side plates, is plotted against a time axis t (sec).

After initial setting of the refractory side plates, in a grinding-in phase alignment errors between the end side of the side plates and the end side of the casting roller which may occur as a result of manufacturing tolerances at the side plates are eliminated. This grinding-in phase, if it is required at all, should last no longer than 120 sec, with the mean side plate wear amounting to at least 10 mm/h, preferably at least 20 mm/h. If appropriate, however, this value is only reached just before the stopper is opened.

The actual casting process starts with a first time interval $\Delta t_1$, during which a horizontal movement of the side plates, in the direction of the casting-roller axes toward the end sides of the casting rollers, takes place in three sections. In a starting phase (1st section), the side plates are moved onto the end sides of the casting rollers during a period of at most 90 sec with a wear or feed rate $v_{s1}$ of from 1.0 mm/h to 20 mm/h. This starting phase lasts for at most 90 sec. Within this starting phase, preferably at the beginning of it, the stopper is opened and the melt pool starts to fill up with metal melt; a maximum value for the feed rate of 50 mm/h is not exceeded during stopper opening and shortly thereafter. This is followed by a transition phase (2nd section), which lasts for at most 120 sec and during which the feed rate $v_{s2}$ of the side plates is less than 10 mm/h and which merges into a steady-state operating phase (3rd section), in which the feed rate $v_{s3}$ is reduced to from 0.2 mm/h to 4.0 mm/h. With the high feed rate $v_{s1}$ during the starting phase, a pronounced sealing edge is ground into the side plate within a very short time, and this sealing edge is continuously maintained and renewed according to natural wear during the casting process. The values $v_{s3}$ given for the operating phase are sufficient for this ongoing renewal process. The side plate material is to be selected accordingly.

At the start of the steady-state operating phase, preferably 10 min after and at the latest 30 min after the start of the first time interval $\Delta t_1$, a second time interval $\Delta t_2$ starts, in which a vertical feed movement, i.e. a feed movement oriented in the casting direction G, of the side plates takes place. The feed rate $v_{v1}$ during undisturbed steady-state casting operation is approximately 4.0 to 10.0 mm/h but may also be within a wider range from 2.0 to 20 mm/h. This vertical feed movement may also be carried out as a function of any faults if strip edge phenomena or wear, force or movement signals from the side plates indicate problems in the steady-state wear process. A further expedient embodiment consists in the vertical feed movement of the side plates being carried out in steps, i.e. a rapid feed movement at a feed rate of $v_{v2}$ from 2.0 to 20 mm/h over a distance of 0.2 to 2.0 mm being followed by a stationary phase of up to 30 min before a further feed movement is initiated. This intermittent feed movement is sufficient to produce a durable sealing surface between casting roller lateral surface and side plate which remains stable with respect to erosion over a prolonged period of time in the circumferential direction as well.

The predetermined hourly wear rates to the side plates, which correspond to a feed rate ($v_{s1}$, $v_{s2}$, $v_{s3}$, $v_{v1}$, $v_{v2}$) of the side plates, can be achieved by controlled contact pressures ($p_{s1}$, $p_{s2}$, $p_{s3}$, $p_{v1}$, $p_{v2}$) which are applied by the horizontal- and vertical-adjustment apparatuses and are transmitted to the side plates and are subsequently under closed-loop control in a measurement and control circuit in accordance with the wear which has been predetermined for steady states. The same result can also be achieved by a mechanical drive in combination with, for example, a process-controlled stepper motor.

Figure 7:
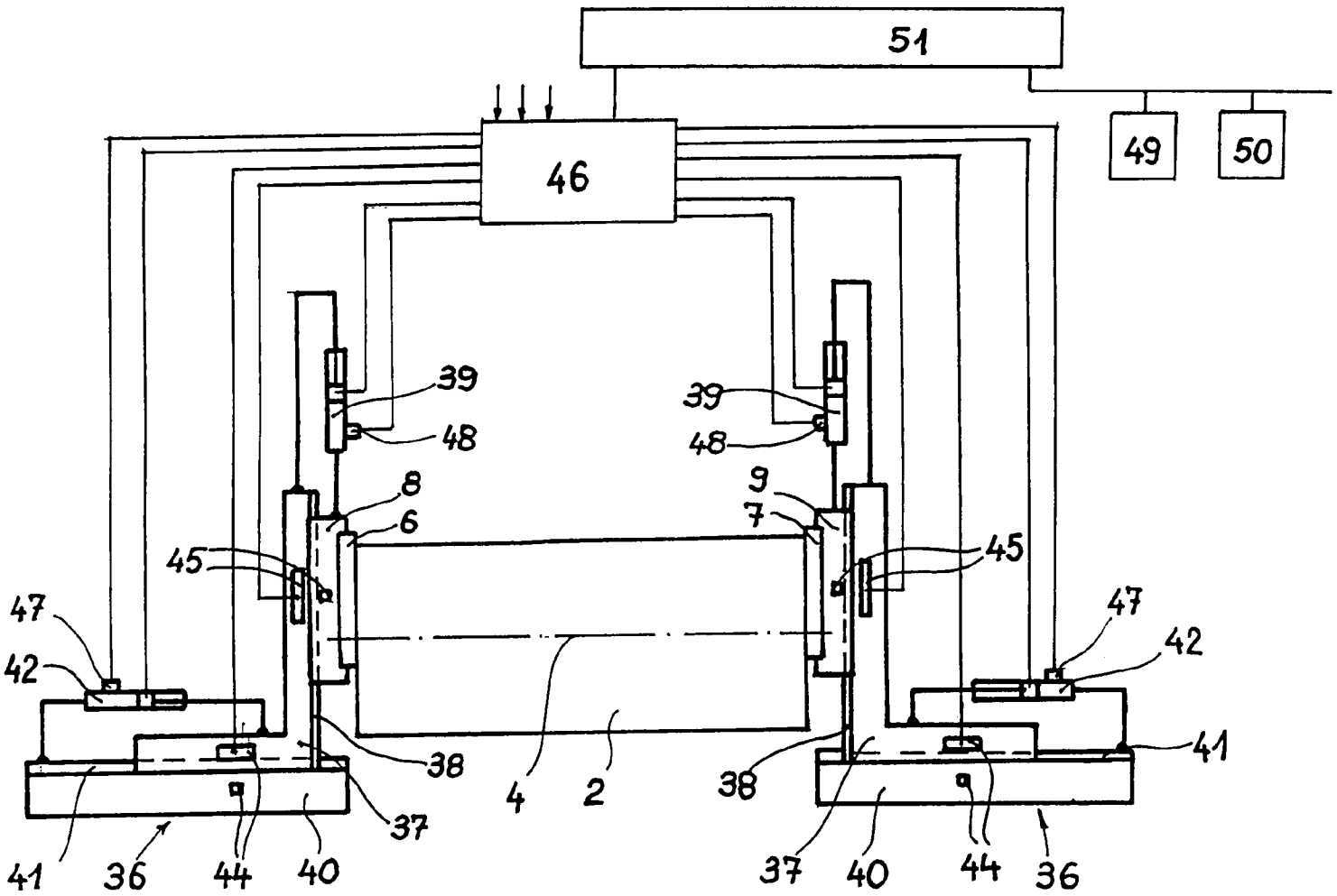
FIG. 7 shows a control circuit diagram for the side plate setting according to the invention.

The control engineering structure of the two-roller casting installation on which the start-up process according to the invention is based is diagrammatically depicted in FIG. 7. Working on the basis of the structure of the side-plate carrying apparatus 36 which has already been illustrated in FIG. 5, with a carrying frame 8, 9, which receives the side plates 6, 7, an adjustment frame 37, on which the corresponding carrying frame 8, 9 is guided in vertical guides 41, and a basic frame 40, on which the adjustment frame 37 is supported and guided in horizontal guides 41, there are position-recording devices 44 for determining the relative position of the respective adjustment frame 37 with respect to the basic frame 40 and position-recording devices 45 for determining the relative position of the respective carrying frame 8, 9 with respect to the adjustment frame 37. In addition, the horizontal-adjustment devices 42 are assigned contact pressure measuring devices 47, and the vertical-adjustment devices 39 are assigned contact pressure measuring devices 48, allowing continuous recording of the side plate wear. All the position-recording devices and contact pressure measuring devices are connected via signal lines to a computer unit 46, which may also be designed as an individual control circuit. By incorporating predetermined or additionally measured input variables, the side plates are set onto the casting rollers in accordance with the selected start-up mode. Alternatively, it is also possible for the input variables to be fed to a higher-level control system 51, where instructions are passed on to the computer unit 46, which operates as an individual control circuit, on the basis of predetermined mathematical models, the control system taking into account influencing variables from other individual control circuits 49, 50 and vice versa.

What is claimed is:

1. A process for producing a metal strip using a two-roller casting device wherein the device comprises: a melt pool formed by two oppositely rotating casting rollers with respective casting-roller axes arranged parallel to one another and by two side plates which bear against end sides of the casting rollers, and the side plates are formed of a material and a casting gap is formed by lateral surfaces of the casting rollers, the process comprising:

introducing metal melt into the melt pool; conveying an at least partially solidified metal strip from the melt pool through the casting gap;

during a first time interval, moving the side plates onto the end sides of the casting rollers in a first direction of movement parallel to the casting-roller axes, and during a second time interval, moving the side plates onto a portion of the lateral surfaces of the casting rollers in a second direction of movement parallel to the casting direction in the casting gap.

2. The process as claimed in claim 1, wherein the first time interval chronologically overlaps the second time interval at least in a subsection of time.

3. The process as claimed in claim 1, wherein the second time interval chronologically overlaps the first time interval at least in a subsection of time.

4. The process as claimed in claim 1, wherein the first time interval starts before the second time interval.

5. The process as claimed in claim 1, wherein the first time interval starts not later than when the metal melt is fed into the melt pool.

6. The process as claimed in claim 1, further comprising moving the side plates onto the casting rollers as a function of the wear properties of the refractory material of the side plates.

7. The process as claimed in claim 1, wherein the first time interval is comprised of three successive phases, including a starting phase, in which the side plates are moved onto the end sides of the casting rollers at a first feed rate which corresponds to material wear to a material of the side plates during the starting phase a transition phase, in which the side plates are moved onto the end sides of the casting rollers at a second feed rate which corresponds to material wear to the side plates during the transition phase a steady-state operating phase, in which the side plates are moved onto the end sides of the casting rollers at a third feed rate which corresponds to material wear to the side plates during the steady-state phase.

8. The process as claimed in claim 1, wherein the first time interval is comprised of three successive phases, including, a starting phase, in which the side plates are pressed onto the end sides of the casting rollers with a first contact pressure which corresponds to material wear to the side plates during the starting phase, a transition phase, in which the side plates are pressed onto the end sides of the casting rollers with a second contact pressure which corresponds to material wear to the side plates during the transition phase, a steady-state operating phase, in which the side plates are pressed onto the end sides of the casting rollers with a third contact pressure which corresponds to material wear to the side plates during the steady-state phase.

9. The process as claimed in claim 1, wherein the second time interval starts not later than 30 mm after the start of the first time interval.

10. The process as claimed in claim 7, wherein the second time interval starts substantially at the start of the steady-state operating phase.

11. The process as claimed in claim 1, wherein during the second time interval, moving or pressing the side plates onto respective edge portions of the lateral surface of the casting rollers at one of a feed rate or a contact pressure which corresponds to material wear to the side plates.

12. The process as claimed in claim 1, wherein during the second time interval moving the side plates intermittently comprising alternating movement phases and stationary phases.

13. The process as claimed in claim 12, wherein during each movement phase, the side plates are moved onto the edge portions of the lateral surface of the casting rollers.

14. The process as claimed in claim 1, further comprising a grind-in phase directly preceding the first time interval and during the grind-in phase the side plates are pressed onto the end sides of the casting rollers at a feed rate or with a contact pressure which corresponds to a mean material wear to the side plates.

15. The process as claimed in claim 1, further comprising a grind-in phase preceding the first time interval causing a mean horizontal material wear to the side plates, the grinding-in phase being carried out with cold or preheated side plates.

16. The process as claimed in claim 7, wherein during the starting phase, the side plates are moved onto the end sides of the casting rollers during a time period of at most 90 sec and the first feed rate is less than 50 mm/h;

during the transition phase, the side plates are moved onto the end sides of the casting rollers during a time period of at most 3 min, at the second feed rate is less than 20 mm/h and;

during the steady-state phase, the side plates are moved onto the end sides of the casting rollers at the third fee rate of between 0.2 mm/h and 4 mm/h.

17. The process as claimed in claim 16, wherein the first feed rate is from 1 mm/h to 30 mm/h.

18. The process as claimed in claim 8, wherein during the starting phase, the side plates are pressed onto the end sides of the casting roller during a period of at most 90 sec, and the first contact pressure which corresponds to material wear to the side plates of less than 50 mm/h;

during the transition phase, the side plates are pressed onto the end sides of the casting rollers during a period of at most 3 min at a second contact pressure which corresponds to material wear to the side plates of less than 20 mm/h; and the third contact pressure during the steady-state phase corresponds to material wear to the side plates of between 0.2 mm/h and 4 mm/h.

19. The process as claimed in claim 18, wherein the first contact pressure corresponds to material wear to the side plates of from 1 mm/h to 30 mm/h.

20. The process as claimed in claim 9, wherein the second time interval starts as early as 10 min after the start of the first time interval.

21. The process as claimed in claim 8, wherein the second time interval starts substantially at the start of the steady-state operating phase.

22. The process as claimed in claim 11, wherein the material wear to the side plates is 2 mm/h to 20 mm/h.

23. The process as claimed in claim 11, wherein the material wear to the side plates is 4 mm/h to 10 mm/h.

24. The process as claimed in claim 12, wherein the stationary phases do not exceed 30 min.

25. The process as claimed in claim 12, wherein the stationary phases do not exceed 5 min.

26. The process as claimed in claim 13, wherein the side plates are moved 0.01 to 2 mm.

27. The process as claimed in claim 13, wherein the side plates are moved 0.1 to 1 mm.

28. The process as claimed in claim 14, wherein the side plates are pressed onto the end sides of the casting rollers during a subsection of this grinding-in phase, the side plates being additionally pressed onto a portion of the lateral surfaces of the casting rollers with a high contact pressure in the casting direction, which corresponds to mean material wear to the side plates of at least 10 mm/h.

29. The process as claimed in claim 14, wherein the side plates are pressed onto the end sides of the casting rollers during a sub section of this grinding-in phase, the side plates being additionally pressed onto a portion of the lateral surfaces of the casting rollers with a high contact pressure in the casting direction, which corresponds to mean material wear to the side plates of at least 20 mm/h.

30. The process as claimed in claim 14, wherein the side plates are pressed onto the end sides of the casting rollers during a sub section of this grinding-in phase, the side plates being additionally pressed onto a portion of the lateral surfaces of the casting rollers with a high contact pressure in the casting direction.

31. The process as claimed in claim 15, wherein the mean horizontal wear to the side plates is at least 0.33 mm.

32. The process as claimed in claim 15, further comprising intermediate heating being carried out between the grinding-in phase and the start of the first time interval.

* * * * *